US011708207B2

(12) United States Patent
Jaeggi

(10) Patent No.: US 11,708,207 B2
(45) Date of Patent: Jul. 25, 2023

(54) WATCH PACKAGING

(71) Applicant: The Swatch Group Research and Development Ltd, Marin (CH)

(72) Inventor: Félix Jaeggi, Bienne (CH)

(73) Assignee: The Swatch Group Research and Development Ltd, Marin (CH)

( * ) Notice: Subject to any disclaimer, the term of this patent is extended or adjusted under 35 U.S.C. 154(b) by 155 days.

(21) Appl. No.: 17/082,474

(22) Filed: Oct. 28, 2020

(65) Prior Publication Data

US 2021/0163203 A1 Jun. 3, 2021

(30) Foreign Application Priority Data

Dec. 2, 2019 (EP) ..... 19212968

(51) Int. Cl.

| | |
|---|---|
| ***B65D 81/02*** | (2006.01) |
| ***B65D 77/04*** | (2006.01) |
| ***B65D 85/40*** | (2006.01) |
| ***B65D 5/42*** | (2006.01) |

(52) U.S. Cl.

CPC ..... *B65D 81/025* (2013.01); *B65D 5/4204* (2013.01); *B65D 77/0413* (2013.01); *B65D 85/40* (2013.01)

(58) Field of Classification Search

CPC .. B65D 85/40; B65D 77/0413; B65D 81/025; B65D 5/4204; B65D 85/30; B65D 85/42; B65D 85/38

USPC ..... 206/6.1, 70, 301, 18, 590

See application file for complete search history.

(56) References Cited

U.S. PATENT DOCUMENTS

| | | | | |
|---|---|---|---|---|
| 4,101,023 | A * | 7/1978 | Schuander | A45C 11/16 220/4.23 |
| 6,398,026 | B1 * | 6/2002 | Parsons | B65D 81/025 206/349 |
| 2005/0103673 | A1 * | 5/2005 | Eichenberger | B65D 81/07 206/301 |
| 2005/0287316 | A1 * | 12/2005 | Croce | B65D 81/24 428/34.1 |
| 2007/0119728 | A1 * | 5/2007 | Au | E05B 73/00 206/301 |
| 2008/0267592 | A1 * | 10/2008 | Fiala | A45C 15/06 386/326 |

(Continued)

FOREIGN PATENT DOCUMENTS

| | | | |
|---|---|---|---|
| CN | 108502366 | A | 9/2018 |
| EP | 0658492 | A1 * | 6/1995 |
| WO | 2014/008397 | A2 | 1/2014 |

OTHER PUBLICATIONS

Notice of the Reason for Refusal dated Oct. 12, 2021 from the Japanese Patent Office in JP Application No. 2020-184204.

European Search Report for EP 19 21 2968 dated May 15, 2020.

*Primary Examiner* — Rafael A Ortiz

(74) *Attorney, Agent, or Firm* — Sughrue Mion, PLLC

(57) ABSTRACT

A protective packaging (2) for an object (4) including: a sheath (6) and an element (8) for supporting the object (4) configured to slide in the sheath (6), characterised in that the element (8) for supporting the object (4) comprises two hollow holding elements (12A, 12B) connected to each other by at least one hinge and at least one of the two hollow holding elements (12A, 12B) has an imprint configured to enclose at least a portion of the object (4) by interlocking.

34 Claims, 10 Drawing Sheets

(56) References Cited

U.S. PATENT DOCUMENTS

| | | | | |
|---|---|---|---|---|
| 2009/0065374 | A1* | 3/2009 | Au | A45C 11/10 206/459.5 |
| 2010/0181227 | A1* | 7/2010 | Tolkowsky | A47F 7/03 206/755 |
| 2011/0132797 | A1* | 6/2011 | Adair | B65D 81/025 206/524.6 |
| 2013/0319904 | A1* | 12/2013 | Montello | B65D 81/025 206/590 |
| 2017/0086316 | A1* | 3/2017 | Schettle | H05K 5/0086 |
| 2017/0334598 | A1* | 11/2017 | Tanus | B65D 1/36 |

* cited by examiner

WATCH PACKAGING

CROSS REFERENCE TO RELATED APPLICATION

This application claims priority to European Patent Application No. 19212968.2.0 filed Dec. 2, 2019, the entire contents of which are incorporated herein by reference.

TECHNICAL FIELD

The invention relates to a packaging for an object and in particular for a wristwatch.

TECHNOLOGICAL BACKGROUND

The published patent document FR 2 044 907 discloses a watch packaging comprising a support ensuring the anchoring of said watch. The support is in the shape of a rigid band and is configured to slide in a transparent sheath thus protecting the watch. This known packaging has the disadvantage that the support and the slide do not allow sufficient protection in the event of an impact. Indeed, a roughness in a fracture area of the sheath could damage the watch.

SUMMARY OF THE INVENTION

The purpose of the invention is to overcome at least one of the disadvantages of the aforementioned prior art. More particularly, the purpose of the invention is to produce a packaging improving the protection of the packaged object. The present invention relates to a protective packaging for an object comprising: a sheath; an element for supporting the object configured to slide in the sheath, remarkable in that the element for supporting the object comprises two hollow holding elements connected to each other by at least one hinge and at least one of the two hollow holding elements has an imprint configured to enclose at least a portion of the object by interlocking.

According to an advantageous embodiment of the invention, the packaging comprises one or more of the following technical features, according to any possible combination:

- the or each hinge is a flexible hinge;
- the two hollow holding elements are made integrally;
- the at least one hinge comprises two hinges, the axes of rotation of which are preferably parallel;
- the two hollow holding elements are respectively shells;
- each hollow holding element comprises a bottom partition, a side wall and two front walls, said partition being delimited laterally by the or each hinge, as well as longitudinally on either side by the two front walls;
- each bottom partition is integral with the hinge or with the corresponding hinge;
- the two hinges are connected to each other by a connecting band, the connecting band being made integrally with the two hollow holding elements;
- each hinge is recessed relative to free edges of the front walls, said edges extending perpendicular to the bottom partition, and being disposed on either side of said hinge;
- each side wall extends perpendicular to the bottom partition;
- each side wall is corrugated in shape;
- each imprint is defined by a portion of the corresponding side wall and a portion of the corresponding bottom partition;

- each side wall is delimited on either side by the corresponding bottom partition and an upper partition;
- each upper partition has a width comprised between 5% and 60% of the width of the corresponding hollow holding element;
- each upper partition is integral with the corresponding side wall and/or the corresponding front walls;
- the element for supporting the object consists of Paper-foam or moulded cellulose;
- the packaging is parallelepiped in shape;
- the sheath has an aperture, preferably said aperture being adapted to coincide with a part of the object, in particular the watch case, when the packaging is closed;
- the object is a watch, preferably a wristwatch;
- at least one of the upper partitions comprises a notch, the shape of which is adapted to receive a lateral portion of the watch, preferably said portion comprising a crown;
- the support element comprises means for adjusting the height of the object;
- the connecting band includes the means for adjusting the height of the object, preferably said means being a flexible strip, in particular a curved flexible strip;
- the connecting band includes two slots which form the flexible strip;
- the support element comprises adaptive means allowing to receive watches whose cases respectively have different diameters;
- said adaptive means include two flexible strips disposed on the two respective side walls (20A, 20B), each strip having a profile adapted to enclose a part of the object, in particular a portion of the watch case;
- each side wall includes two parallel interstices forming the corresponding flexible strip;
- locking means, said means including at least one hook arranged on one of the hollow holding elements and at least one complementary aperture formed on the other hollow holding element;
- the or each hook is disposed at the corresponding upper partition, and the or each complementary aperture is formed on the other upper partition;
- the or each hook is made integrally with the corresponding upper partition;
- the support element comprises means for limiting shear deformation;
- the shear deformation limiting means comprise tabs and complementary grooves, the tabs being adapted to engage in the complementary grooves;
- two of the tabs formed respectively on two of the front walls facing each other are offset in a direction parallel to the at least one hinge;
- each tab extends from the free edge of the corresponding front wall, preferably said tab having a rounded end;
- each groove is formed on the external or internal face of the corresponding front wall.

In general, the advantageous embodiments of each object of the invention are also applicable to the other objects of the invention. As far as possible, each object of the invention can be combined with other objects. The objects of the invention can also be combined with the embodiments of the description, which in addition can be combined with each other.

The means of the invention advantageously allow to impart very good rigidity to the packaging. Not only does the sheath participate in the protection in the shape of a first protective element, but also, the support element has a rigid structure forming a second protective element, providing additional protection in the event that the first protective element would not be sufficient to absorb an impact. The means of the invention also allow the watch to be anchored without clearance in its packaging while guaranteeing easy removal of said watch after opening the packaging. Thus, these means prevent the watch from moving in the packaging. Furthermore, thanks to these means, the packaging can be made of recyclable materials (for example cellulose-based materials), while guaranteeing the same performances in terms of resistance and protection as the conventional packaging. In addition, cellulose-based materials are less brittle than plastics traditionally used for packaging. Finally, the packaging can be lightened thanks to its optimised shape, while having mechanical features comparable to known solutions.

BRIEF DESCRIPTION OF THE FIGURES

The invention will be described in more detail below using the appended drawings, given by way of non-limiting examples, wherein.

DETAILED DESCRIPTION OF THE INVENTION

Figure 1:
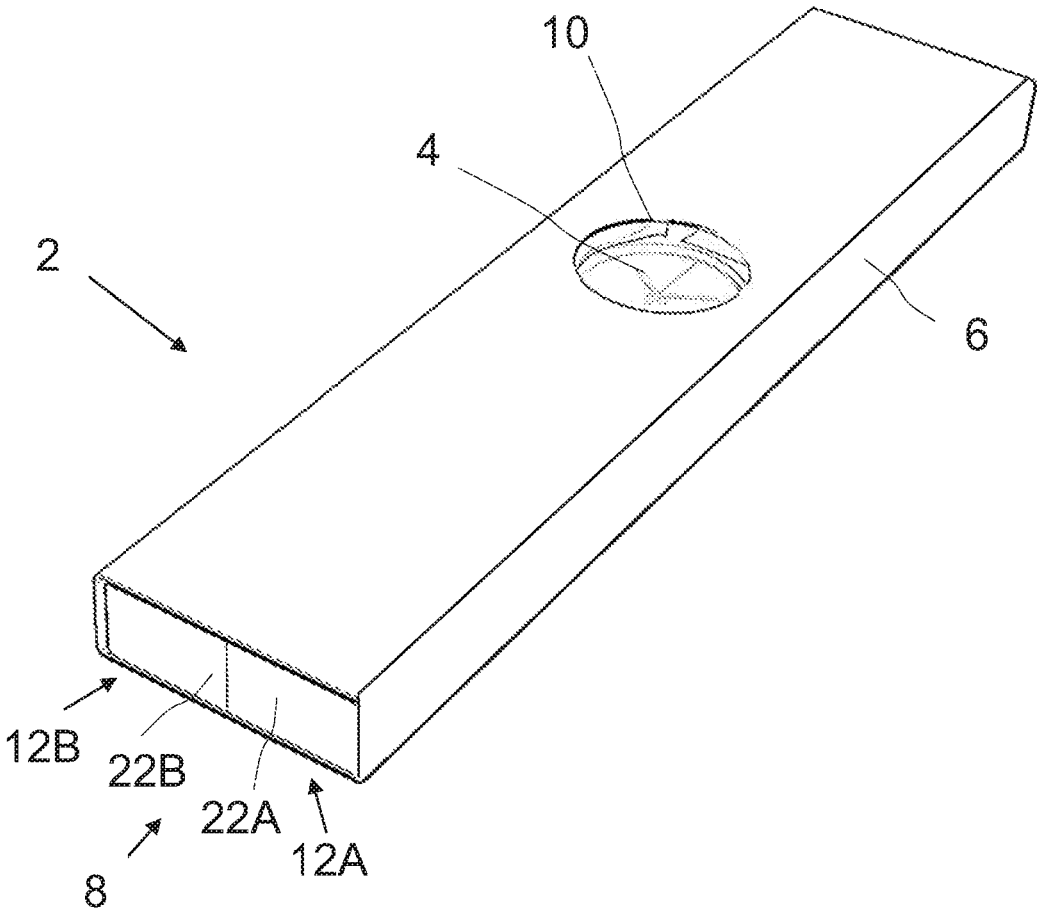
FIG. 1 shows a schematic perspective view of a packaging according to the invention containing an object, in particular a wristwatch, the packaging being closed.

FIG. 1 shows a protective packaging 2 for an object 4, in particular a wristwatch 4 including a watch case to which two wristlet strands are attached. The packaging 2 comprises a sheath 6 and an element 8 for supporting the object 4. The element 8 for supporting the object 4 is slidably mounted in the sheath 6. The element 8 for supporting the object 4 is preferably elongated in shape when the object is a wristwatch 4. The sheath 6 and the support element 8 can have the same length as illustrated in FIG. 1. The support element 8 can have a shape inscribing within a rectangular parallelepiped which is of a shape complementary to the volume delimited by the sheath 6. The sheath 6 may comprise an aperture 10 to see for example the watch head that is to say the watch case 4 without the bracelet being entirely visible. The object is maintained by two elements called holding elements 12A, 12B. FIG. 1 shows the packaging 2 before it is opened.

Figure 2:
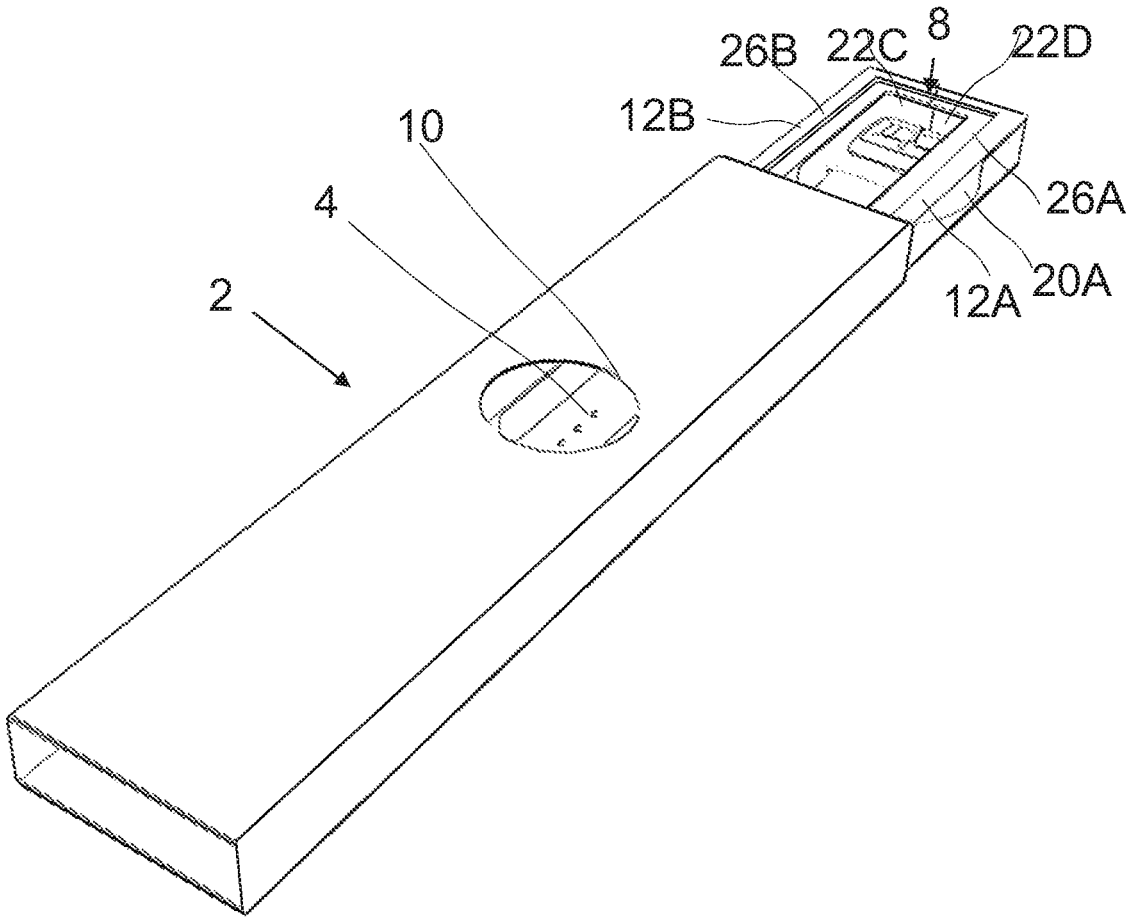
FIG. 2 illustrates a schematic perspective view of the packaging according to the invention, the packaging being partially open.

FIG. 2 shows a packaging 2 after sliding the sheath 6 along a portion of the length of the support element 8. The holding elements 12A, 12B respectively have hollow and preferably curved and/or ribbed shapes having the effect of improving the rigidity of these thin-walled structures (shells) by the hollow body effect and increase in quadratic moments.

Figure 3:
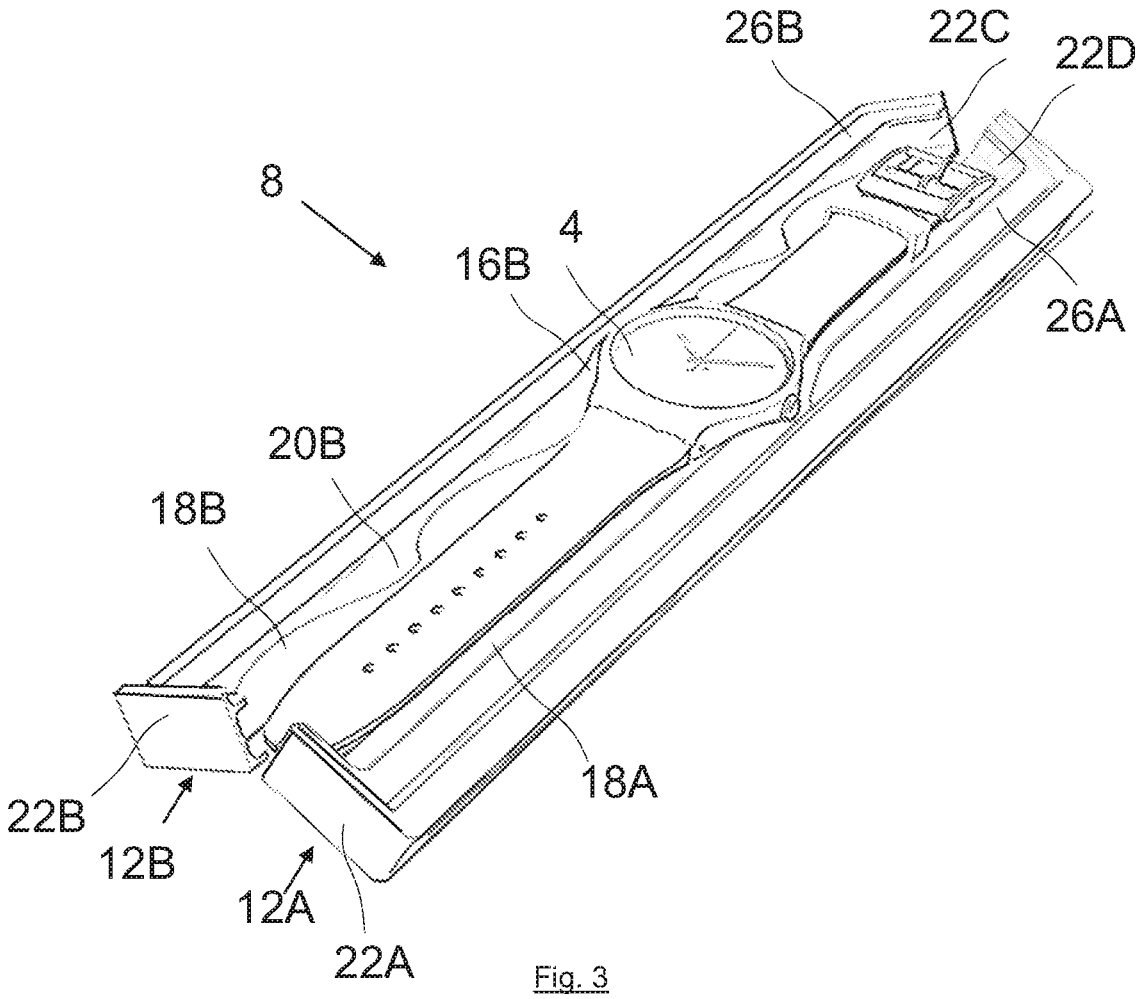
FIG. 3 shows a schematic perspective view of a watch mounted on its support element according to the invention, the watch support element being partially unfolded.

FIG. 3 illustrates only the support element 8 in combination with the object 4, that is to say a wristwatch. The two hollow holding elements 12A, 12B are connected to each other by a hinge-type connection 14A, 14B. The removal of the object is facilitated by the pivoting between the two hollow holding elements 12A, 12B.

Figure 4:
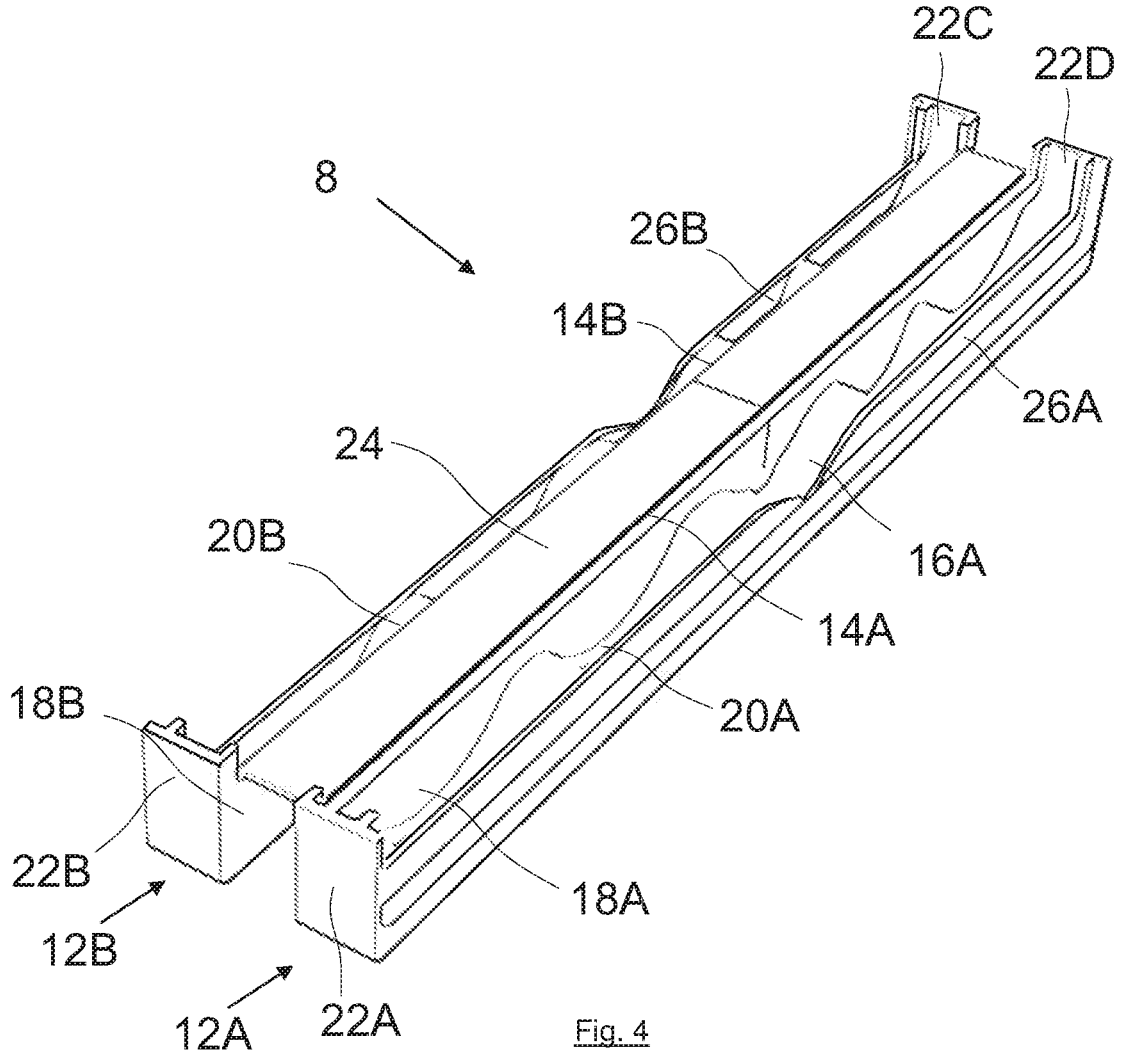
FIG. 4 illustrates a schematic perspective view of the support element of the watch according to the invention in the unfolded position without the watch.

FIG. 4 shows the support element 6 without the object 4 in an unfolded position. The hinge-type connection 14A, 14B may comprise two hinges 14A, 14B, in order to increase the number of degrees of freedom of the connection between the two hollow holding elements 12A, 12B and in order to better be able to overcome any resistance during releasing of the object from its imprints 16A, 16B, the shape of which corresponds substantially to the outer contour of the watch case. Preferably, the two hollow holding elements 12A, 12B are made integrally. The two hollow holding elements 12A, 12B can be made from moulded cellulose or from Paperfoam® (registered trademark for a family of products whose features are well known). Typically, the packaging can be advantageously directly injection-moulded in a single operation in its open configuration as shown in FIG. 4. Paperfoam® is a material based on a mixture of industrial starch, cellulose fibres, and water injected into the mould during manufacturing. The connection between the two hollow holding elements 12A, 12B can comprise two flexible-type hinges 14A, 14B, the axes of rotation of which are preferably parallel. Each hollow holding element 12A, 12B preferably includes a bottom partition 18A, 18B, a side wall 20A, 20B and two front walls 22A, 22B, 22C, 22D. The two front walls 22A, 22B, 22C, 22D of the hollow holding element 12A, 12B in question can be disposed on either side of the corresponding bottom partition 18A, 18B. The two hinges 14A, 14B are preferably connected to each other by a connecting band 24 which will also be used as a support surface for the case and the wristlet of the watch that the packaging is intended to receive. The band 24 is preferably made integrally with the two hollow holding elements 12A, 12B. Each hinge 14A, 14B may be recessed relative to free edges of the front walls 22A, 22B, 22C, 22D. The latter 22A, 22B, 22C, 22D preferably extend perpendicular to the bottom partition 18A, 18B and are preferably disposed on either side of the hinge 14A, 14B in question. The recess can be comprised between 5% and 30% of the width of each bottom partition 18A, 18B.

In FIG. 4, each side wall 20A, 20B is corrugated and extends between the bottom partition 18A, 18B and a corresponding upper partition 26A, 26B. The imprints 16A, 16B can be defined respectively by central portions of the side walls 20A, 20B facing each other and by portions of the corresponding bottom partitions 18A, 18B. Each upper partition 26A, 26B can comprise flat portions parallel to each other, forming steps. These flat portions are preferably parallel to the corresponding bottom partition 18A, 18B. The upper partitions 26A, 26B, and the bottom partitions 18A, 18B as well as the side walls 20A, 20B respectively form two beam structures having very good flexural rigidity. Each upper partition 26A, 26B can have a width comprised between 5% and 60% of the width of the hollow holding element 12A, 12B.

The two hollow holding elements 12A, 12B preferably have a symmetry called mirror symmetry and constitute two "halves" of the support element 8, with the exception of the imprints or notches formed in the upper walls 26A, 26B allowing to receive lateral portions of the watch case 4 including, for example, one with a crown and the other without a crown. The size and shape of the notches can naturally vary depending on the shape of the watch that the packaging is intended to receive.

The embodiment according to FIGS. 1-4 has two hinges 14A, 14B. In an alternative embodiment not shown, the packaging 2 can comprise a single flexible hinge.

FIGS. 5-10 show another embodiment of a packaging according to the invention. This embodiment incorporates the features of the embodiment according to FIGS. 1-4 and further comprises additional means to improve among others the rigidity and modularity of the packaging 2.

Figure 5:
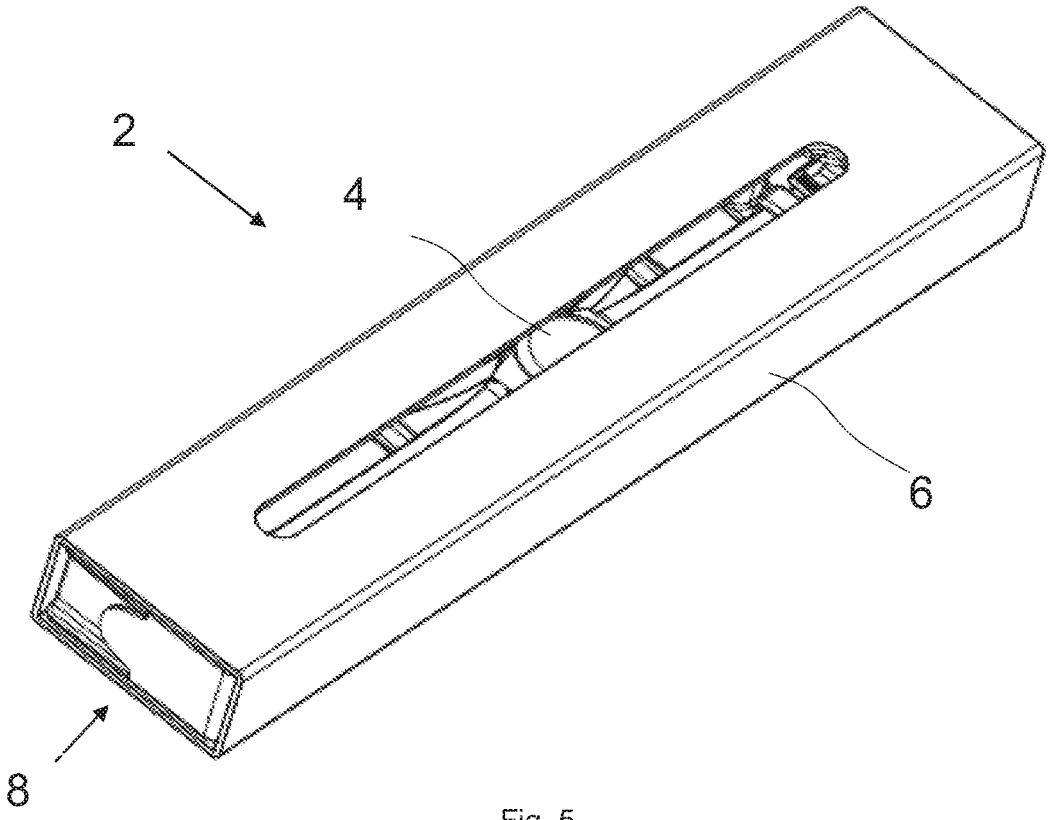
FIG. 5 shows a schematic perspective view of another embodiment of a packaging according to the invention containing an object.
Figure 6:
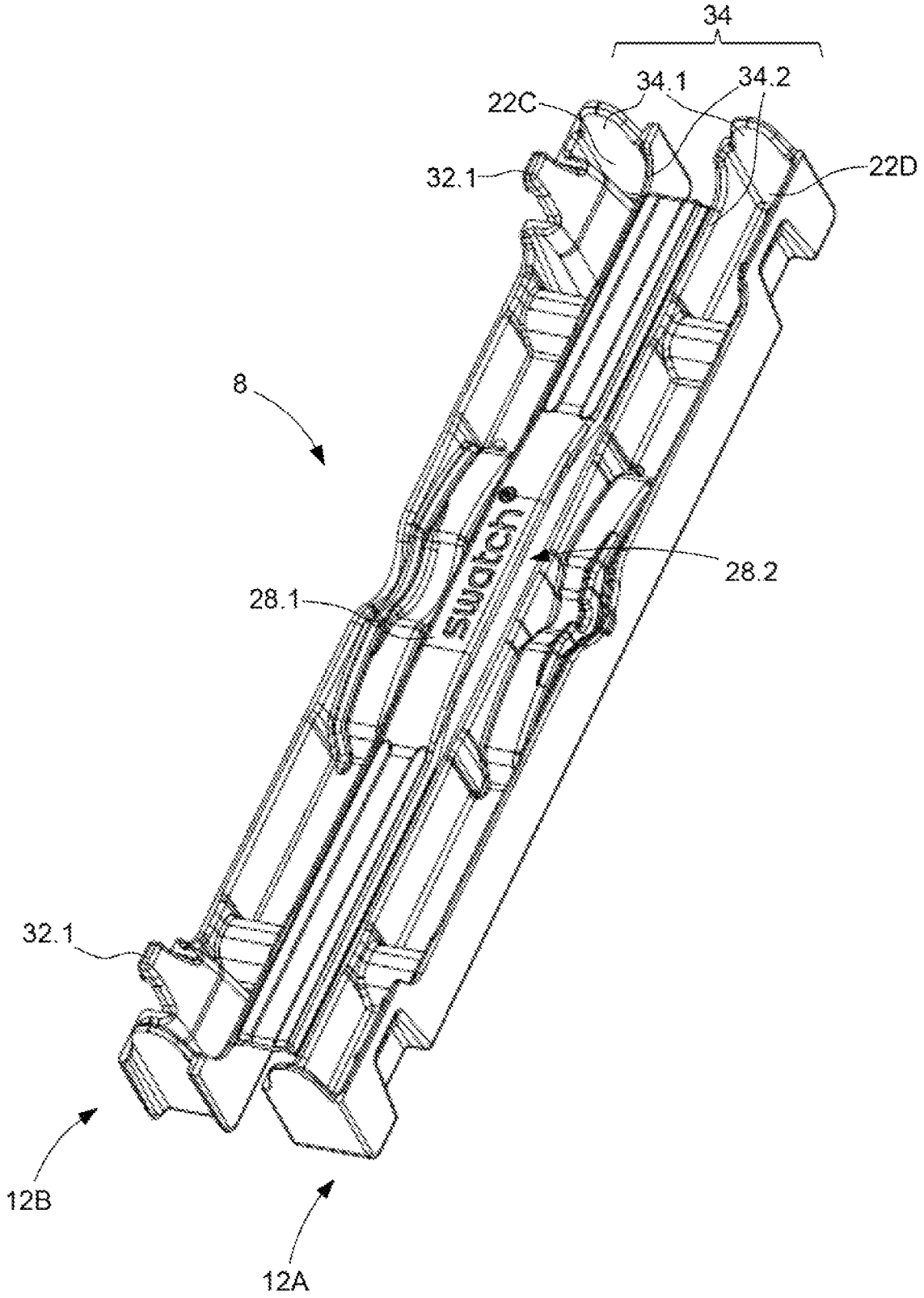
FIG. 6 illustrates a schematic perspective view of the upper face of a watch support element of this other embodiment in the unfolded position without the watch.
Figure 7:
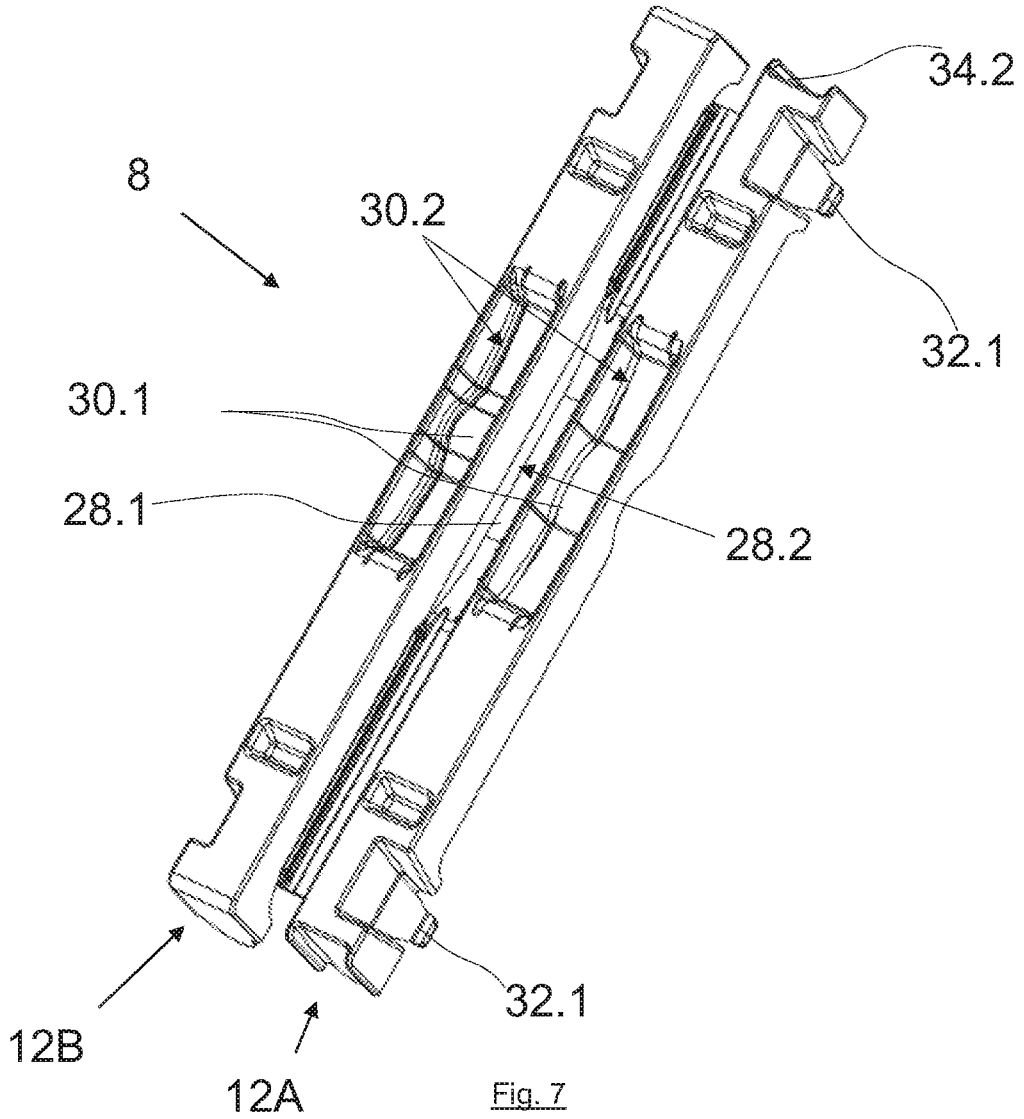
FIG. 7 shows a schematic perspective view of the lower face of the watch support element of this other embodiment, in the unfolded position without the watch.
Figure 8A:
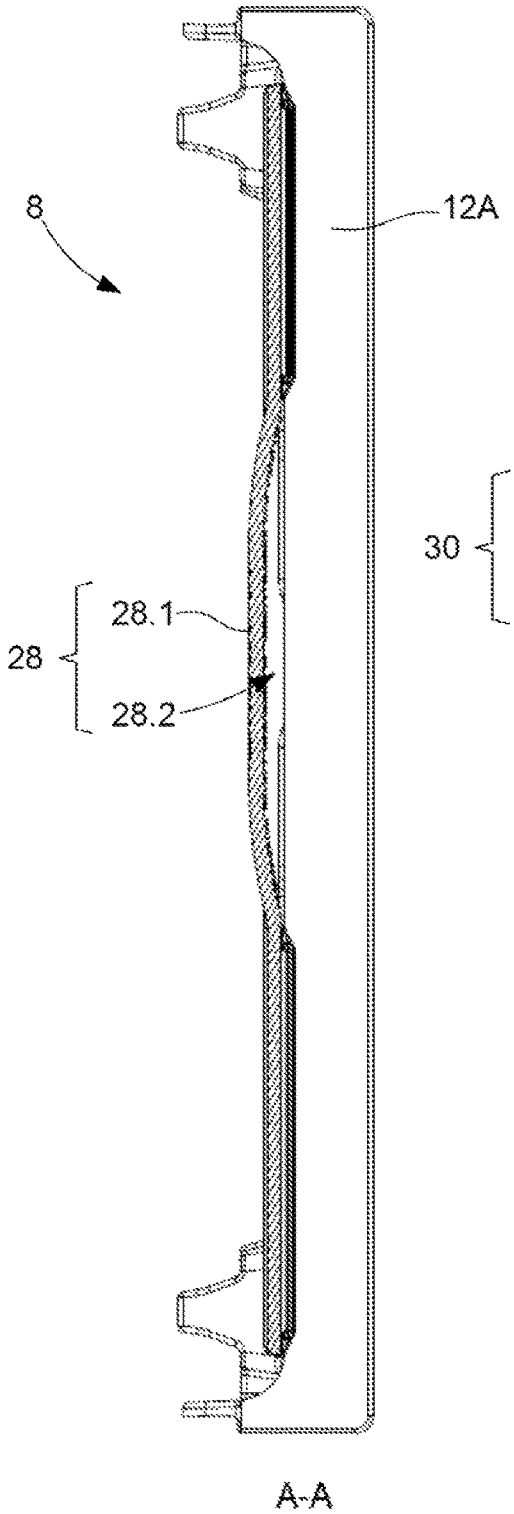
FIGS. 8*a* and 8*b* respectively illustrate a schematic view of a section along a vertical median plane and a view from top to bottom, of this other embodiment of the watch support element according to the invention in the unfolded position without the watch.
Figure 8B:
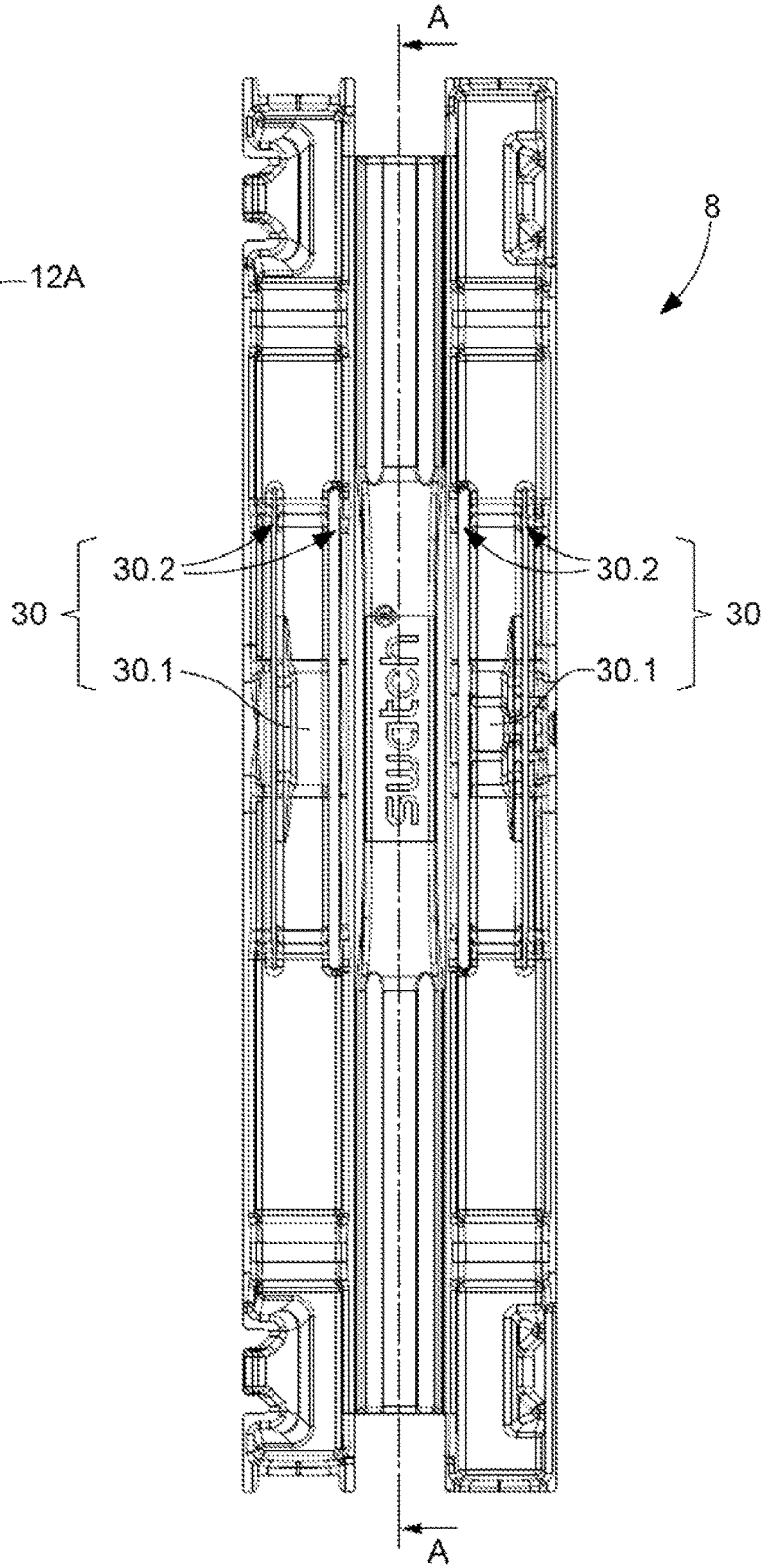
Figure 9A:
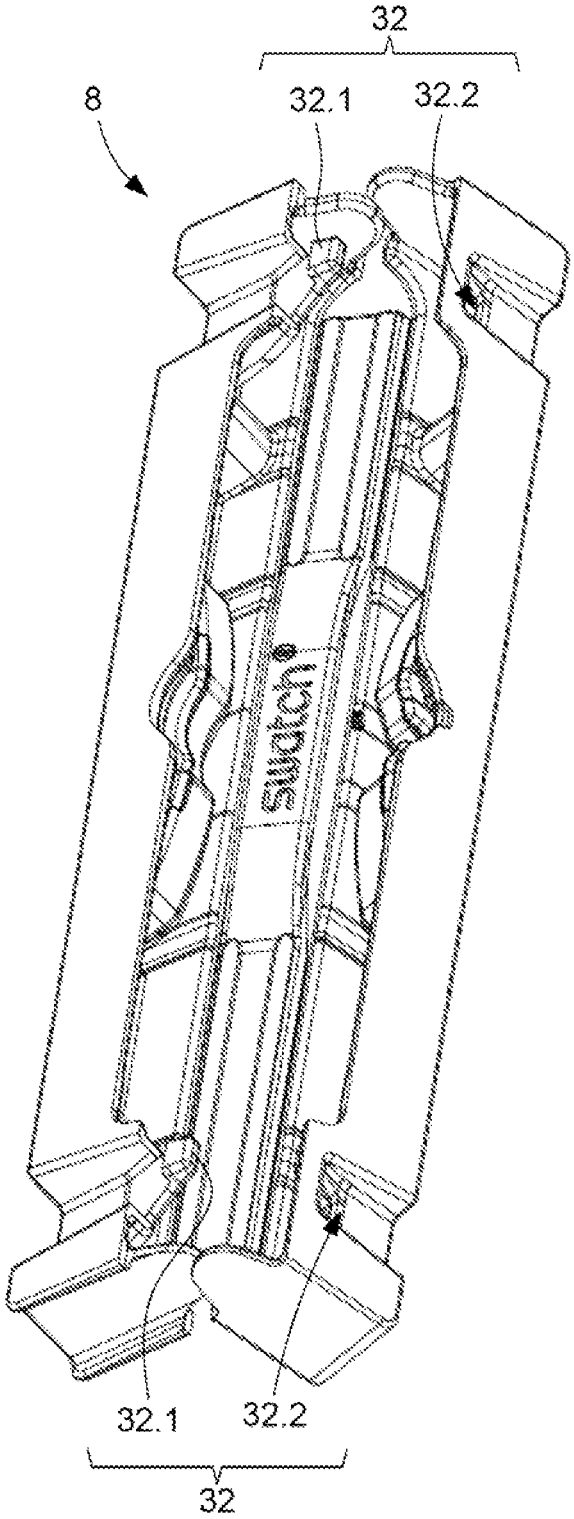
FIGS. 9*a* and 9*b* respectively show a schematic perspective view of this other embodiment of the support element without a watch and the same support element with watch according to the invention, the support element being partially unfolded in both representations.
Figure 9B:
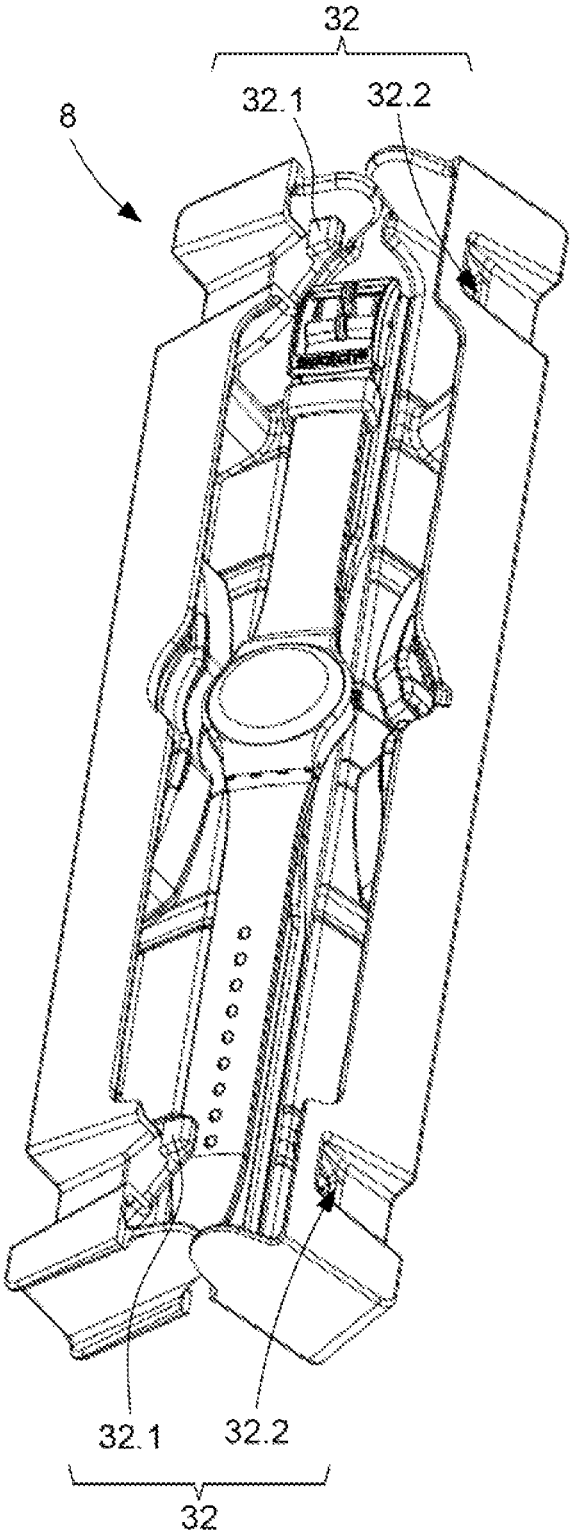
Figure 10:
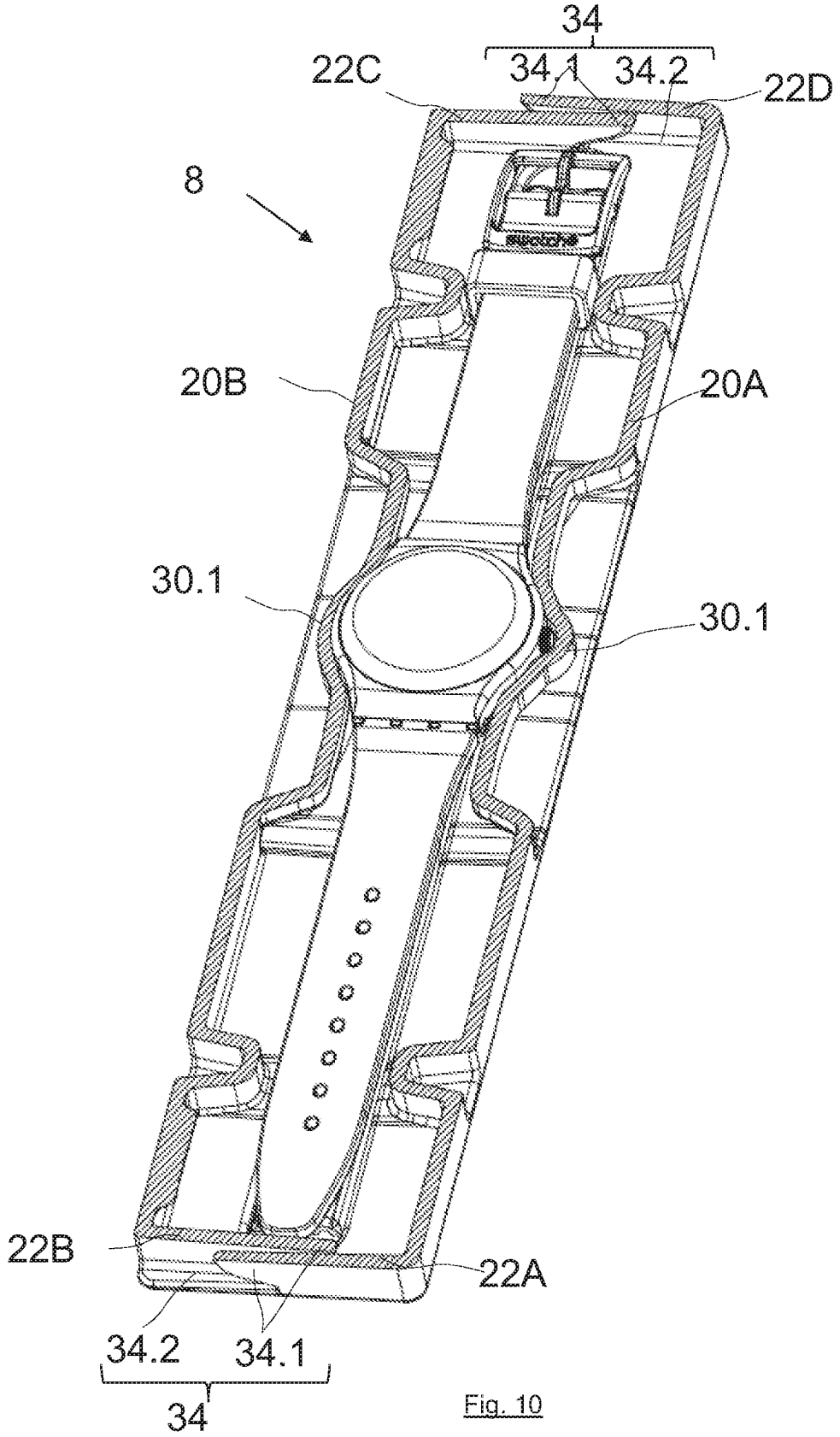
FIG. 10 shows a schematic sectional perspective view of this other embodiment of the support element, the section being taken in a horizontal median plane.

FIG. 5 shows a schematic perspective view of the other embodiment of a packaging 2 according to the invention containing an object 4.

As illustrated in FIGS. 6, 7, 8*a* and 8*b*, the support element 8 includes means 28 for adjusting the height of the watch case 4 in the packaging 2, disposed at the connecting band 24. The height adjustment means 28 may include a flexible blade 28.1, the two ends of which are integral with the connecting band 24 and an intermediate part of which between its ends is curved in the direction away from the connecting band 24. Preferably, the flexible blade 28.1 is made integrally with the connecting band 24. The flexible blade 28.1 is formed by two parallel slots 28.2 formed on the connecting band 24, which has a curvature at its central part. These means allow to receive watch cases having different thicknesses.

In FIGS. 6, 7, 8*a* and 8*b*, the imprints 16A, 16B may comprise adaptive means 30 allowing to receive watch heads whose cases respectively have different diameters. The side walls 20A, 20B can respectively comprise flexible strips 30.1. Each flexible strip 30.1 has two ends integral with its side wall 20A, 20B and an intermediate part between its ends. Each intermediate part is a curved strip, the profile of which is adapted to enclose the watch case 4. Preferably, each flexible strip 30.1 is made integrally with its side wall 20A, 20B. Each flexible strip may be formed by two parallel interstices (slots) 30.2 provided on its side wall 20A, 20B, preferably at the junctions with the corresponding bottom partition 18A, 18B and the corresponding upper wall 26A, 26B.

As illustrated in FIGS. 6, 7, 8*a*, 8*b*, 9*a* and 9*b*, the (hollow) holding elements 12A, 12B can be held in the closed position by locking means 32. The locking means 32 comprise at least one hook 32.1 arranged on one of the (hollow) holding elements 12A, 12B and disposed at the corresponding upper partition 26A, 26B. The or each hook 32.1 is of complementary shape to an aperture 32.2 formed on the other upper partition 26A, 26B. The or each hook 32.1 (male part) and the complementary aperture 32.2 (female part) can constitute an elastic snap-fit. Preferably, the or each hook 32.1 is integral with the corresponding upper partition 26A, 26B. The or each hook 32.1 can be carried by an elastic arm connected to the corresponding upper partition 26A, 26B.

In FIGS. 6, 7, 8*a*, 8*b*, 9*a*, 9*b* and 10, the support element 8 comprises shear deformation limiting means 34 provided at the front walls 22A, 22B, 22C, 22D. The shear deformation limiting means 34 can comprise tabs 34.1 and complementary grooves 34.2, the tabs 34.1 being adapted to engage in complementary grooves 34.2. Each tab 34.1 includes a rounded end facilitating the engagement of each tab 34.1 into the corresponding groove 34.2 when closing the support element 8. When the support element 8 is in the closed position, the interlocking between each tab 34.1 and its groove 34.2 prevent relative movement between the wafers (that is to say the free edges) vis-à-vis the respective front walls 22A, 22B, 22C, 22D. Preferably, the grooves 34.2 are formed on the external or internal faces of the front walls 22A, 22B, 22C, 22D.

LEGEND OF FIGURES

2 packaging
4 object, watch, wristwatch
6 sheath
8 object support element
10 aperture
12A, 12B (hollow) holding element
14A, 14B (flexible) hinge (type connection)
16A, 16B imprint
18A, 18B bottom partition
20A, 20B (corrugated) side wall
22A, 22B, 22C, 22D front walls
24 (connecting) band
26A, 26B upper partition
28 height adjustment means
28.1 flexible blade
28.2 slot
30 adaptive means
30.1 flexible strip
30.2 interstice
32 locking means
32.1 hook
32.2 (complementary) aperture
34 shear deformation limiting means
34.1 tab
34.2 groove

The invention claimed is:

1. A protective packaging for an object comprising:

a sheath extending in a longitudinal direction; and a support base on which the object sits for supporting a bottom portion of the object, said support base being configured to slide in the sheath in the longitudinal direction, wherein the support base comprises two hollow holding elements connected to each other by a hinge extending in the longitudinal direction, wherein the two holding elements are movable between an open state and a closed state, wherein in the open state the object is between and supported by the two holding elements, wherein at least one of the two hollow holding elements has an imprint configured to enclose at least a portion of the object by interlocking the two holding elements in the closed state, wherein the imprint has a shape which conforms to a contoured shape of the portion of the object being enclosed to contact and securely hold the object in place when the holding elements are in a closed state, and wherein at least one of the holding elements has an opening in a top portion thereof through which the object can be viewed when the holding elements are in the closed state.

2. The protective packaging according to claim 1, wherein the hinge is a flexible hinge.

3. The protective packaging according to claim 1, wherein the two hollow holding elements are made integrally.

4. The protective packaging according to claim 1, wherein the hinge comprises two hinges, the axes of rotation of which are parallel.

5. The protective packaging according to claim 1, wherein the two hollow holding elements are respectively shells.

6. The protective packaging according to claim 1, wherein each hollow holding element comprises a bottom partition, a side wall and two front walls, said partition being delimited laterally by the hinge, as well as longitudinally on either side by the two front walls.

7. The protective packaging according to claim 6, wherein each bottom partition is integral with the hinge.

8. The protective packaging according to claim 4, wherein the two hinges are connected to each other by a connecting band, the connecting band being made integrally with the two hollow holding elements.

9. The protective packaging according to claim 6, wherein the hinge is recessed relative to free edges of the front walls, said edges extending perpendicular to the bottom partition, and being disposed on either side of said hinge.

10. The protective packaging according to claim 6, wherein each side wall extends perpendicular to the bottom partition.

11. The protective packaging according to claim 6, wherein each side wall is corrugated in shape.

12. The protective packaging according to claim 6, each imprint is defined by a portion of the corresponding side wall and a portion of the corresponding bottom partition.

13. The protective packaging according to claim 6, wherein each side wall is delimited on either side by the corresponding bottom partition and an upper partition.

14. The protective packaging according to claim 13, wherein each upper partition has a width comprised between 5% and 60% of the width of the corresponding hollow holding element.

15. The protective packaging according to claim 13, wherein each upper partition is integral with the corresponding side wall and/or the corresponding front walls.

16. The protective packaging according to claim 1, wherein the support base for supporting the object includes paperfoam or moulded cellulose.

17. The protective packaging according to claim 1, wherein the packaging is parallelepiped in shape.

18. The protective packaging according to claim 1, wherein the sheath has an aperture, said aperture being adapted to coincide with a part of the object, in particular a watch case, when the packaging is closed.

19. The protective packaging according to claim 1, wherein the object is a wristwatch.

20. The protective packaging according to claim 13, wherein the object is a wristwatch and at least one of the upper partitions comprises a notch configured to receive a lateral portion of the watch (4), preferably said portion comprising a crown.

21. The protective packaging according to claim 1, wherein the support base comprises means for adjusting the height of the object.

22. The protective packaging (2) according to claim 1, wherein each hollow holding element comprises a bottom partition, a side wall and two front walls, said partition being delimited laterally by the or each hinge, as well as longitudinally on either side by the two front walls, wherein each bottom partition is integral with the hinge or with the corresponding hinge, wherein the two hinges are connected to each other by a connecting band, the connecting band being made integrally with the two hollow holding elements, the support base comprises means for adjusting the height of the object and the connecting band includes the means for adjusting the height of the object, said means being a curved flexible strip.

23. The protective packaging according to claim 22, wherein the connecting band includes two slots which form the flexible strip.

24. The protective packaging according to claim 6, wherein the support base comprises adaptive means allowing to receive watches whose cases respectively have different diameters.

25. The protective packaging according to claim 24, wherein said adaptive means include two flexible strips disposed on the two respective side walls, each strip having a profile adapted to enclose a part of the object, in particular a portion of the watch case.

26. The protective packaging according to claim 6, wherein each side wall includes two parallel interstices forming the corresponding flexible strip.

27. The protective packaging according to claim 1, comprising locking means including at least one hook arranged on one of the hollow holding elements and at least one complementary aperture formed on the other hollow holding element.

28. The protective packaging according to claim 1, wherein each hollow holding element comprises a bottom partition, a side wall and two front walls, said partition being delimited laterally by the hinge, as well as longitudinally on either side by the two front walls, wherein each side wall is delimited on either side by the corresponding bottom partition and an upper partition, wherein the packaging further comprises locking means, said means including at least one hook arranged on one of the hollow holding elements and at least one complementary aperture formed on the other hollow holding element and wherein the or each hook is disposed at the corresponding upper partition, and the or each complementary aperture is formed on the other upper partition.

29. The protective packaging according to claim 28, wherein the or each hook is made integrally with the corresponding upper partition.

30. The protective packaging according to claim 1, wherein the support base comprises shear deformation limiting means.

31. The protective packaging according to claim 30, wherein the shear deformation limiting means comprise tabs and complementary grooves, the tabs being adapted to engage in the complementary grooves.

32. The protective packaging according to claim 31, wherein each hollow holding element comprises a bottom partition, a side wall and two front walls, said partition being delimited laterally by the hinge, as well as longitudinally on either side by the two front walls and wherein two of the tabs formed respectively on two of the front walls facing each other are offset in a direction parallel to the hinge.

33. The protective packaging according to claim 32, wherein each hinge is recessed relative to free edges of the front walls, said edges extending perpendicular to the bottom partition, and being disposed on either side of said hinge, wherein the shear deformation limiting means comprise tabs and complementary grooves, the tabs being adapted to engage in the complementary grooves and wherein each tab extends from the free edge of the corresponding front wall, said tab having a rounded end.

34. The protective packaging (2) according to claim 30, wherein each hollow holding element comprises a bottom partition, a side wall and two front walls, said partition being delimited laterally by the hinge, as well as longitudinally on either side by the two front walls, wherein the shear deformation limiting means comprise tabs and complementary grooves, the tab being adapted to engage in the complementary grooves and wherein each groove is formed on the external or internal face of the corresponding front wall.

* * * * *